US007753237B2

(12) United States Patent
Tsai

(10) Patent No.: US 7,753,237 B2
(45) Date of Patent: Jul. 13, 2010

(54) HOLDING AND ACTUATING DEVICE FOR PRESSURIZED CAN

(75) Inventor: Eric Tsai, Tali (TW)

(73) Assignee: Apex Mfg. Co., Ltd., Tali (TW)

( * ) Notice: Subject to any disclaimer, the term of this patent is extended or adjusted under 35 U.S.C. 154(b) by 651 days.

(21) Appl. No.: 11/470,423

(22) Filed: Sep. 6, 2006

(65) Prior Publication Data

US 2008/0017674 A1 Jan. 24, 2008

(30) Foreign Application Priority Data

Jul. 19, 2006 (TW) ..... 95126379 A

(51) Int. Cl.
*B65D 83/18* (2006.01)
*B65D 83/20* (2006.01)

(52) U.S. Cl. ..... 222/323; 222/402.15; 222/474

(58) Field of Classification Search ..... 222/174, 222/323, 324, 402.13, 402.15, 472–475, 222/465.1; 239/375; 16/425; 294/28, 30, 294/31.1, 33, 34, 145; 215/396; 24/511, 24/546, 460, 462
See application file for complete search history.

(56) References Cited

U.S. PATENT DOCUMENTS

| | | | | | |
|---|---|---|---|---|---|
| 1,160,924 | A | * | 11/1915 | Mangish et al. | 99/306 |
| 1,404,669 | A | * | 1/1922 | Turco | 294/28 |
| 1,970,631 | A | | 8/1934 | Sherman | 222/498 |
| 2,336,924 | A | * | 12/1943 | Cordis | 222/89 |
| 2,618,499 | A | * | 11/1952 | Scharf | 294/28 |
| 2,691,466 | A | | 10/1954 | Efford et al. | 222/182 |
| 2,820,578 | A | | 1/1958 | Dickman | 222/323 |
| 2,868,421 | A | | 1/1959 | Schott | 222/473 |
| 2,960,260 | A | | 11/1960 | Kutik | 222/473 |
| 3,734,357 | A | | 5/1973 | Batistelli et al. | 222/323 |
| 4,505,335 | A | * | 3/1985 | Hayba | 222/402.15 |
| 4,660,745 | A | | 4/1987 | Hess, Jr. | 227/174 |
| 4,805,812 | A | | 2/1989 | Brody | 222/402.11 |
| 5,137,180 | A | * | 8/1992 | Kieras | 222/108 |
| 5,819,985 | A | | 10/1998 | Brody | 222/153.09 |
| 6,029,862 | A | * | 2/2000 | Jones | 222/402.15 |
| 2003/0218029 | A1 | | 11/2003 | Brody | 222/402.15 |

OTHER PUBLICATIONS

UK Patent Publication No. GB2218471 A1, Nov. 15, 1989, 8 pages.

(Continued)

*Primary Examiner*—Kenneth Bomberg
(74) *Attorney, Agent, or Firm*—Alan Kamrath; Kamrath & Associates PA

(57) ABSTRACT

A device for holding and actuating a can includes a body, a holder and a trigger. The can includes a neck, a rim formed on the neck, a push-button valve and a nozzle installed on the push-button valve. The body includes a handle and a connective portion extended from the handle. The holder is arranged on the connective portion of the body and is formed with two jaws for clipping the neck of the can and for supporting the rim of the can. The trigger is installed on the handle and is formed with a first end to be operated by a user's finger and a second end inserted into the holder for contact with the push-button valve of the can.

19 Claims, 14 Drawing Sheets

OTHER PUBLICATIONS

United Kingdom Patent Publication No. GB 2080884 A, Feb. 10, 1982, 8 pages.

Taiwanese Patent Publication No. TW 479566, Mar. 11, 2002, 7 pages.

Taiwanese Patent Publication No. TW M254275, Jan. 1, 2005, 6 pages.

Japanese Patent Publication No. JP 07-22990, Apr. 25, 1995, 5 pages.

* cited by examiner

HOLDING AND ACTUATING DEVICE FOR PRESSURIZED CAN

BACKGROUND OF INVENTION

1. Field of Invention

The present invention relates to a holding and actuating device for holding and actuating a pressurized can.

2. Related Prior Art

Disclosed in U.S. Pat. No. 5,819,985 is an actuating and holding device 10 for holding and actuating a can 12 . The can 12 includes a push-button valve 14 and an annular rim 26. The actuating and holding device 10 includes a body 16 and a locking ring 38.

The body 16 includes a handle 18 and a forward portion 20. The forward portion 20 includes an engagement element 22 for engagement with the annular rim 26 of the can 12. The engagement element 22 includes a gap 24 defined therein, cam surfaces 52 formed on an external edge and a slot 46 defined in the external edge. There is a trigger 36 installed on the handle 18. There is a lever 30 with an end located in the gap 24 and an opposite end connected to the trigger 36.

The locking ring 38 includes a straight portion 40, two prongs 44 extended from an internal edge and an engagement finger 48 extended from the internal edge. The engagement finger 48 is located corresponding to the straight portion 40.

The locking ring 38 is installed around the engagement element 22. The internal edge of the locking ring 38 is in compliance with the external edge of the engagement element 22 including the cam surfaces 52. The prongs 44 are inserted in the slot 46. Thus, the locking ring 38 is not rotational relative to the engagement element 22. When the trigger 36 is operated, the push-button valve 14 is pushed via the lever 30.

There are problems encountered in the use of this conventional actuating and holding device 10. Firstly, it is not durable. The engagement element 22 is made of plastic. The cam surfaces 52 are worn away after some time of use so that the contact between the external edge of the engagement element 22 and the internal edge of the locking ring 38 is loose.

Secondly, it is not convenient. The engagement finger 48 must be pushed downwards so that the prongs 44 can be inserted into the slot 46. The engagement finger 48 must be pushed upwards so that the prongs 44 can be removed from the slot 46. Space around the engagement finger 48 is, however, limited and renders it difficult to operate the engagement finger 48.

Furthermore, the locking ring 38 is arranged around the engagement element 22 after the engagement element 22 is arranged around the annular rim 26. However, the area of the locking ring 38 and that of the engagement element 22 are limited and renders it difficult to operate the locking ring 38 and the engagement element 22.

Therefore, the present invention is intended to obviate or at least alleviate the problems encountered in the prior art.

SUMMARY OF INVENTION

According to the present invention, a device is provided for holding and actuating a can. The can includes a neck, a rim formed on the neck, a push-button valve and a nozzle installed on the push-button valve. The device includes a body, a holder and a trigger. The body includes a handle and a connective portion extended from the handle. The holder is arranged on the connective portion of the body and formed with two jaws for clipping the neck of the can and for supporting the rim of the can. The trigger is installed on the handle and formed with a first end to be operated by a user's finger and a second end inserted into the holder for pushing the push-button valve of the can.

An advantage of the holding and actuating device according to the present invention is the simple structure, because the elements are made in one piece.

Another advantage of the holding and actuating device according to the present invention is durability, since most of the elements are made in one piece and are not worn away by rubbing against one another.

Yet another advantage of the holding and actuating device according to the present invention is convenient operation, because the jaws can be opened wider for receiving the neck of the bottle.

Other advantages and features of the present invention will become apparent from the following description referring to the drawings.

BRIEF DESCRIPTION OF DRAWINGS

The present invention will be described via detailed illustration of three embodiments referring to the drawings.

DETAILED DESCRIPTION OF EMBODIMENTS

Figure 1:
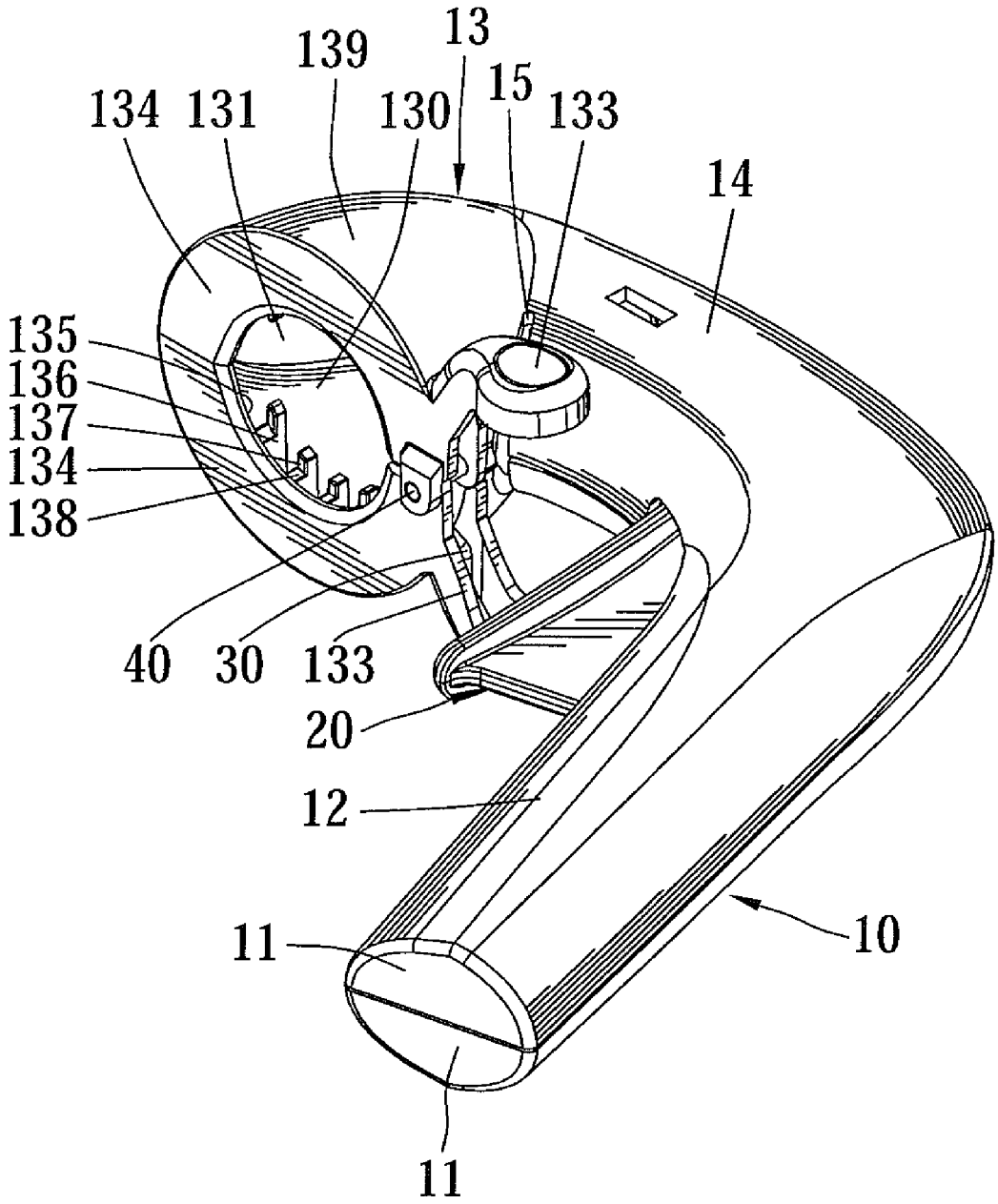
FIG. 1 is a perspective view of a holding and actuating device according to the first embodiment of the present invention.
Figure 2:
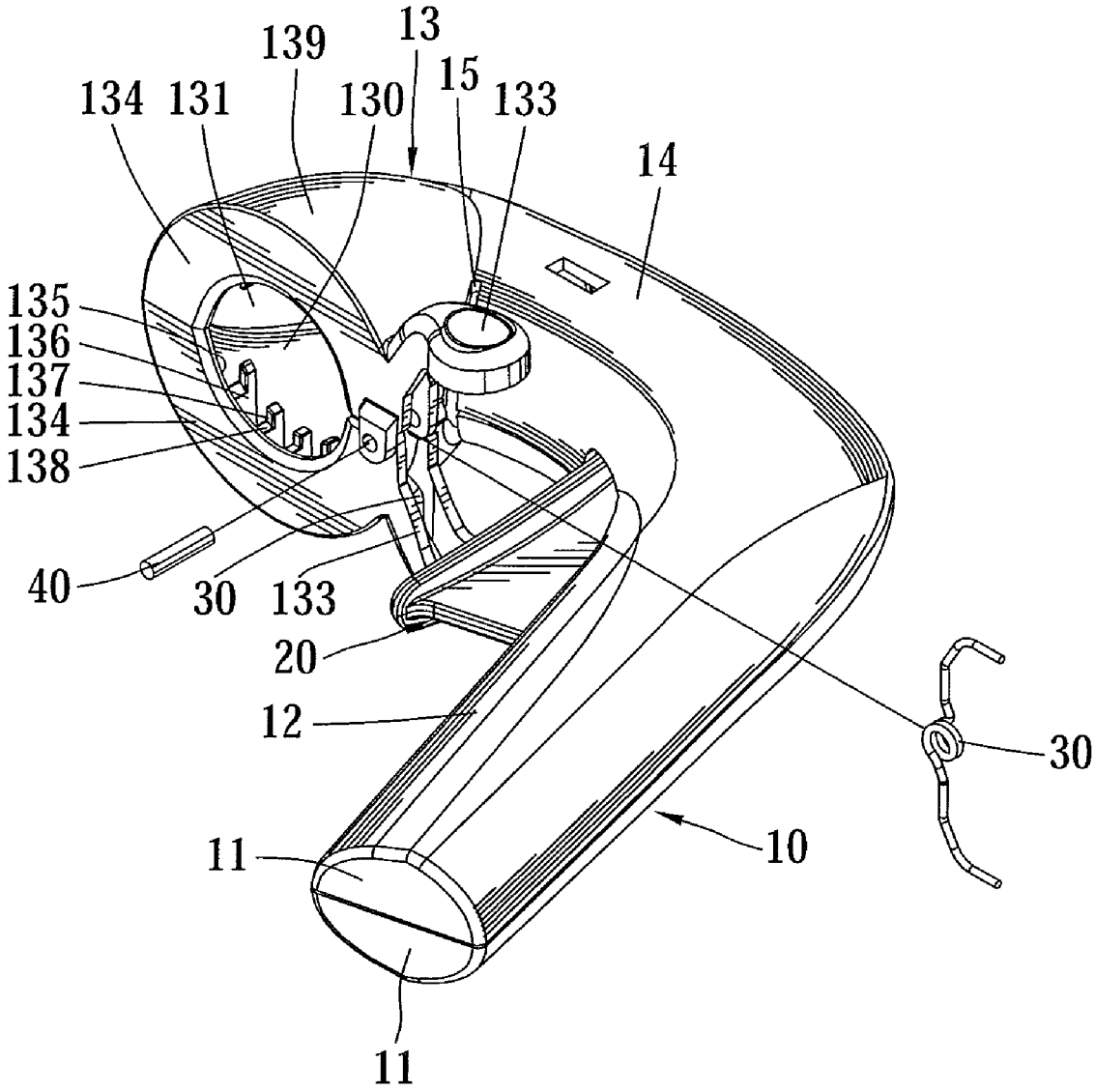
FIG. 2 is an exploded view of the holding and actuating device shown in FIG. 1.

Referring to FIGS. 1 through 8, there is shown a holding and actuating device according to a first embodiment of the present invention. The holding and actuating device is used to hold and actuate a can 50 that contains pressurized spray. The can 50 includes a neck 52 of a reduced size, a rim 53 formed around the neck 52, a push-button valve 54 installed on the neck 52 and a nozzle 51 installed on the push-button valve 54.

The holding and actuating device includes a body 10, a holder 13 installed on the body 10 and a trigger 20 installed on the body 10. The holder 13 is used to hold the rim 53. The trigger 20 is used to actuate the push-button valve 54. The body 10 includes two halves 11 joined together. Each of the halves 11 of the body 10 includes a half of a handle 12 and a half of a connective portion 14 extended from the half of the handle 12. The connective portion defines an opening 15 for receiving the holder 13. The trigger 20 is installed on the handle.

The holder 13 is in the form of a clip. The holder 13 includes first and second jaws 134 and two handles 133. Each of the jaws 134 and a related one of the halves of the connective portion 14 are preferably made as one piece. However, each of the jaws 134 and a related one of the halves of the connective portion 14 may be made separately and then connected to each other. The opening 15 is defined between a portion of each of the jaws 134 and a portion of a related of the halves of the connective portion 14 for increasing flexibility. The jaws 134 are pivotally connected to each other by a pin 40. Each of the handles 133 is extended from a related one of the jaws 134. An elastic element 30 is arranged between the handles 133 for biasing the jaws 134 to a closed position. The elastic element 30 is preferably a torque spring. When the handles 133 are pushed towards each other, the jaws 134 are moved to an open position.

The jaws 134 define a space 130 and an aperture 131 in communication with the space 130. Each of the jaws 134 includes a support surface 135 of a C-shape and for supporting the rim 53 of the can 50, with the support surfaces 135 of the first and second jaws 134 each having a first end 135*a* and a second end 135*b*. When the jaws 134 are in the closed position, the first ends 135*a* abut, and the second ends 135*b* abut. When the jaws 134 are in the open position, the first ends 135*a* are spaced. The support surfaces 135 of the jaws 134 are pivotally connected. Each of the jaws 134 include a wall 139 extending from the support surface 135 and between the support surface 135 and the connective portion 14. Each of the walls 139 opposite to the support surface 135 is flexibly connected to the related one of the first and second halves of the connective portion 14, with the opening 15 defined therebetween. The support surfaces 135 and the walls 139 define the space 130, with the aperture 131 formed between and by front edges 139*a* of the walls 139 of the jaws 134 and spaced from the support surfaces 135 and the connective portion 14. The aperture 131 is in communication with the nozzle 51. The front edges 139*a* of the walls 139 are spaced when the jaws 134 are in the open position. Each of the jaws 134 further includes a plurality of buckles 136 extended from the support surface 135. Each of the buckles 136 includes a base 138 extended from the support surface 135 and a tip 137 extended from the base 138.

The trigger 20 includes a first end 21 located in front of the handle and a second end 22 extended through the opening 15. The first end 21 of the trigger 20 is to be operated by a user's finger. The second end 22 of the trigger 20 is used to push the push-button valve 54.

Figure 7:
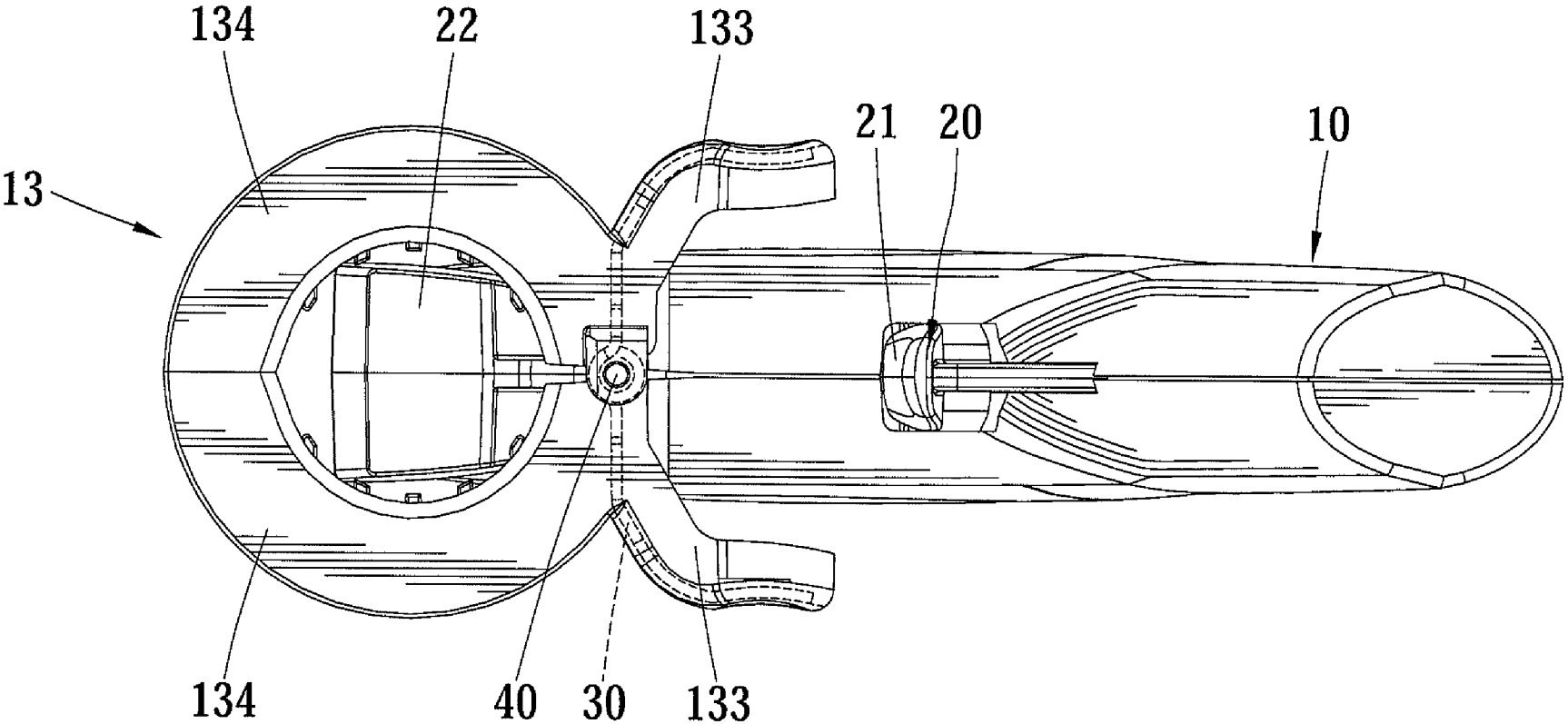
FIG. 7 is a top view of the holding and actuating device of FIG. 1.

Referring to FIG. 7, the jaws 134 are closed.

Figure 6:
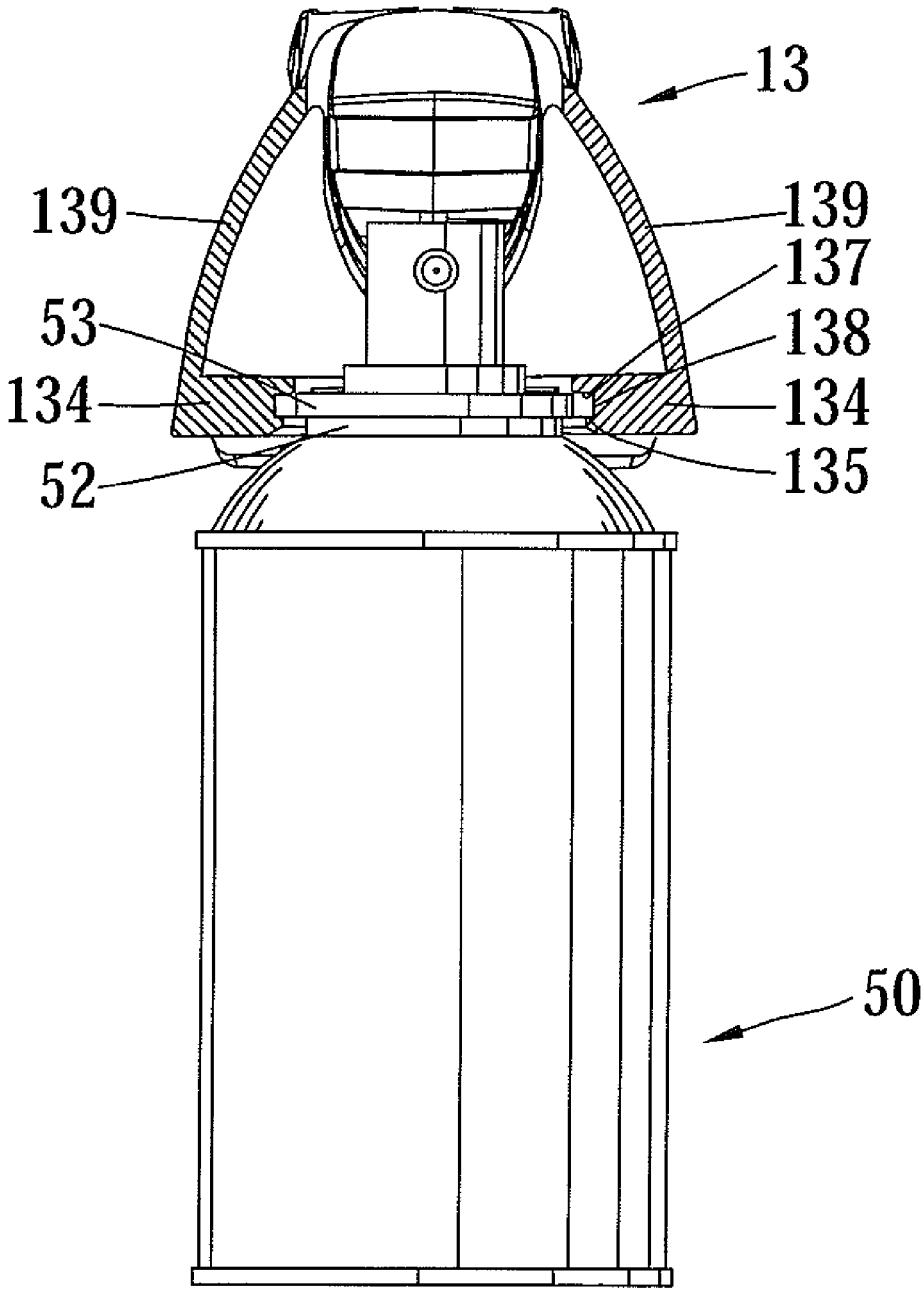
FIG. 6 is a cross-sectional view of the holding and actuating device in another position than shown in FIG. 5.
Figure 8:
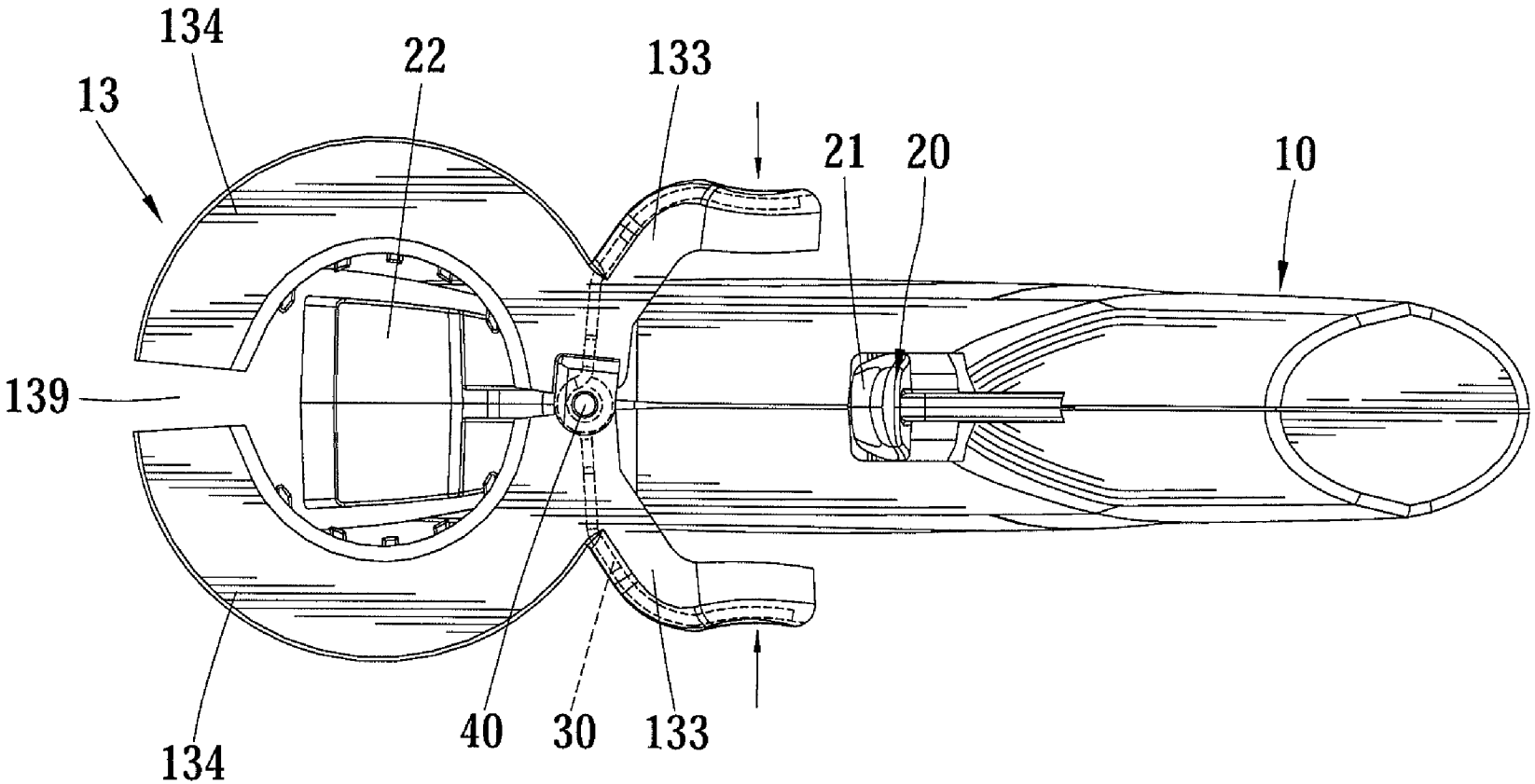
FIG. 8 is a top view of the holding and actuating device than shown in FIG. 7.

Referring to FIGS. 6 and 8, the handles 133 are pushed towards each other so that the jaws 134 are opened, and a gap 139 is defined between the jaws 134. The jaws 134 are arranged around the neck 52, and the support surfaces 135 are located beneath a lower surface of the rim 53.

Figure 5:
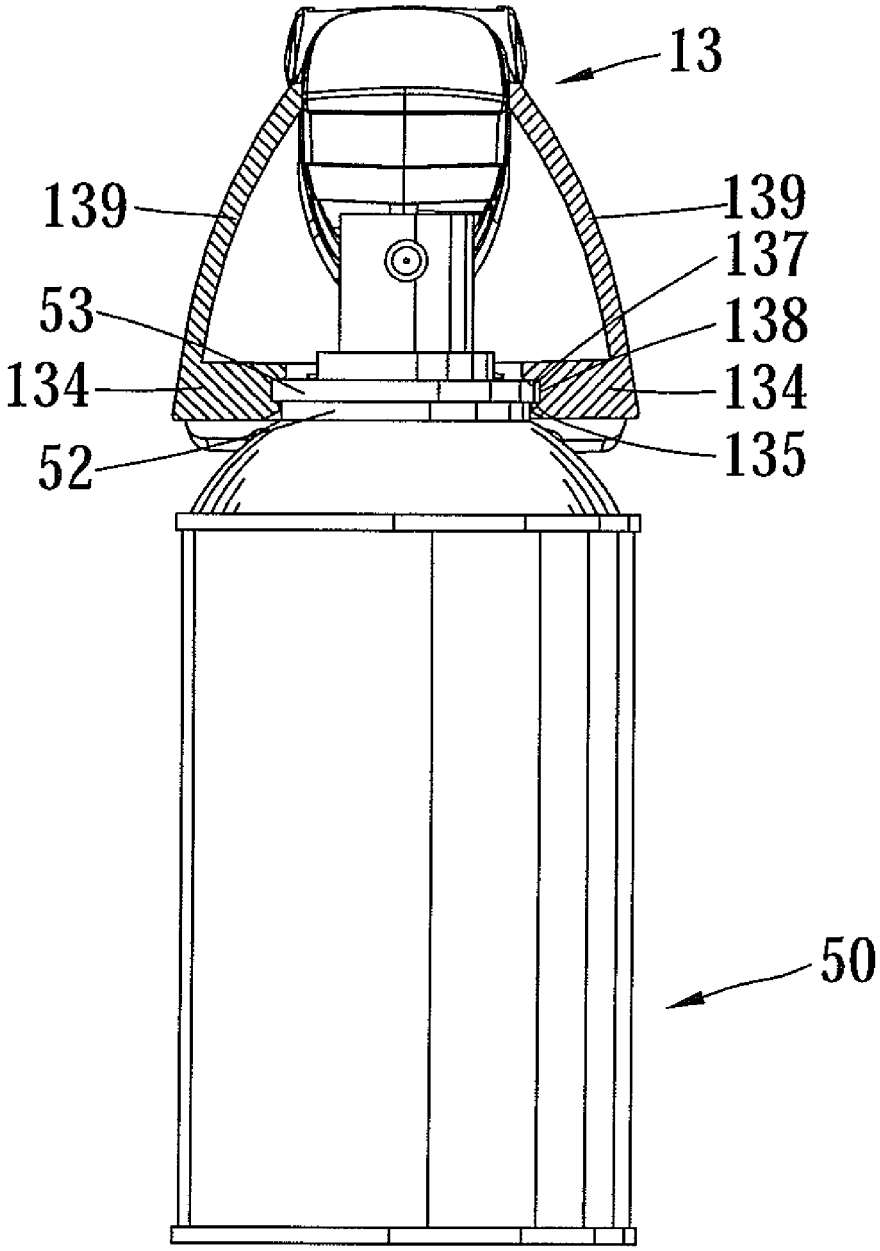
FIG. 5 is a cross-sectional view of the holding and actuating device taken along a line 5-5 in FIG. 3.

Referring to FIGS. 5 and 7, the handles 133 are released so that the jaws 134 are closed due to the elasticity of the jaws 134 and that of the elastic element 30. The neck 52 is clipped by the jaws 134. The lower surface of the rim 53 is located on the support surfaces 135, and an upper surface of the rim 53 is located beneath the tips 137 of the buckles 136. The rim 53 is clipped by the bases 138 of the buckles 136. The can 50 is held by the holding and actuating device.

Figure 3:
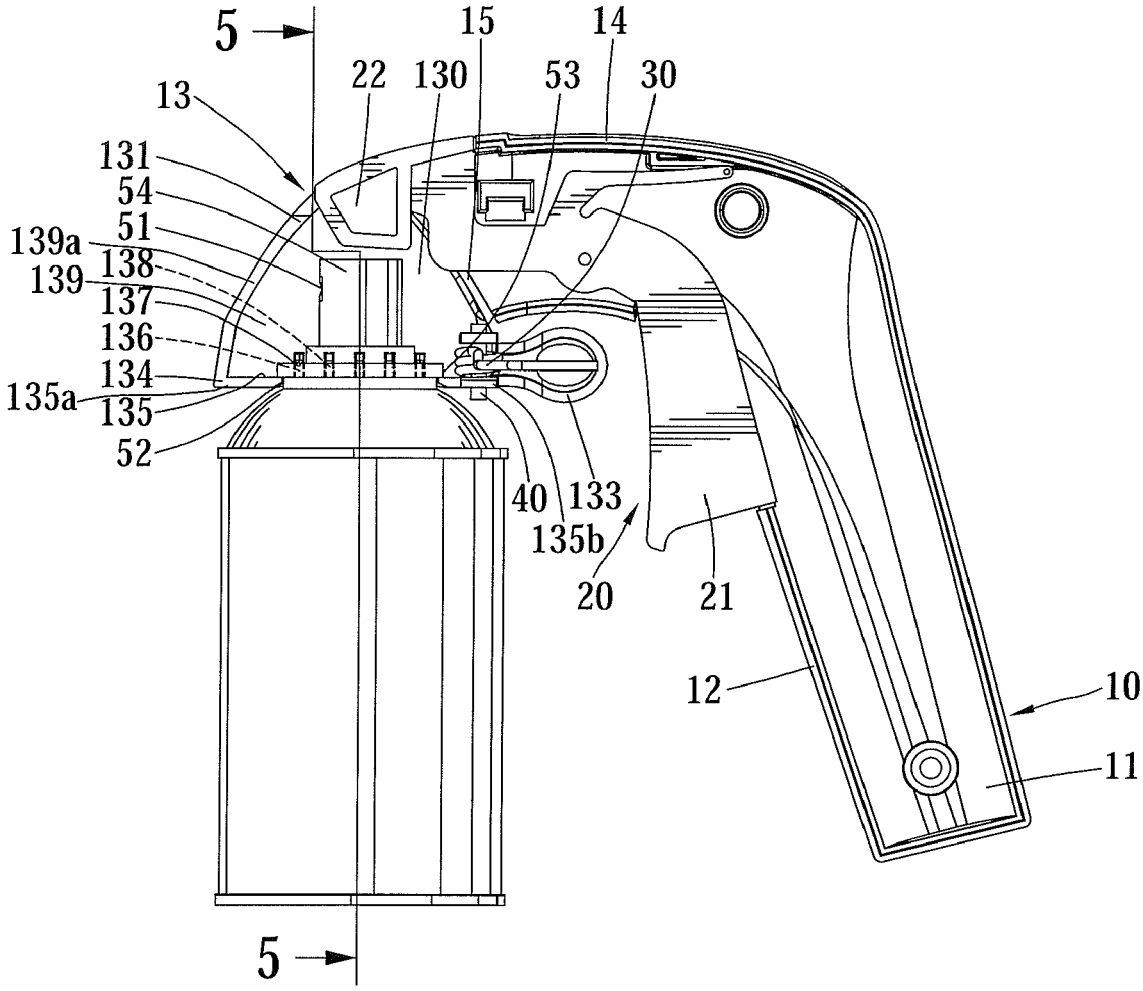
FIG. 3 is a cross-sectional view of a can held by the holding and actuating device shown in FIG. 1.

Referring to FIG. 3, the first end 21 of the trigger 20 is not pushed, and the push-button valve 54 is not pushed by the second end 22 of the trigger 20.

Figure 4:
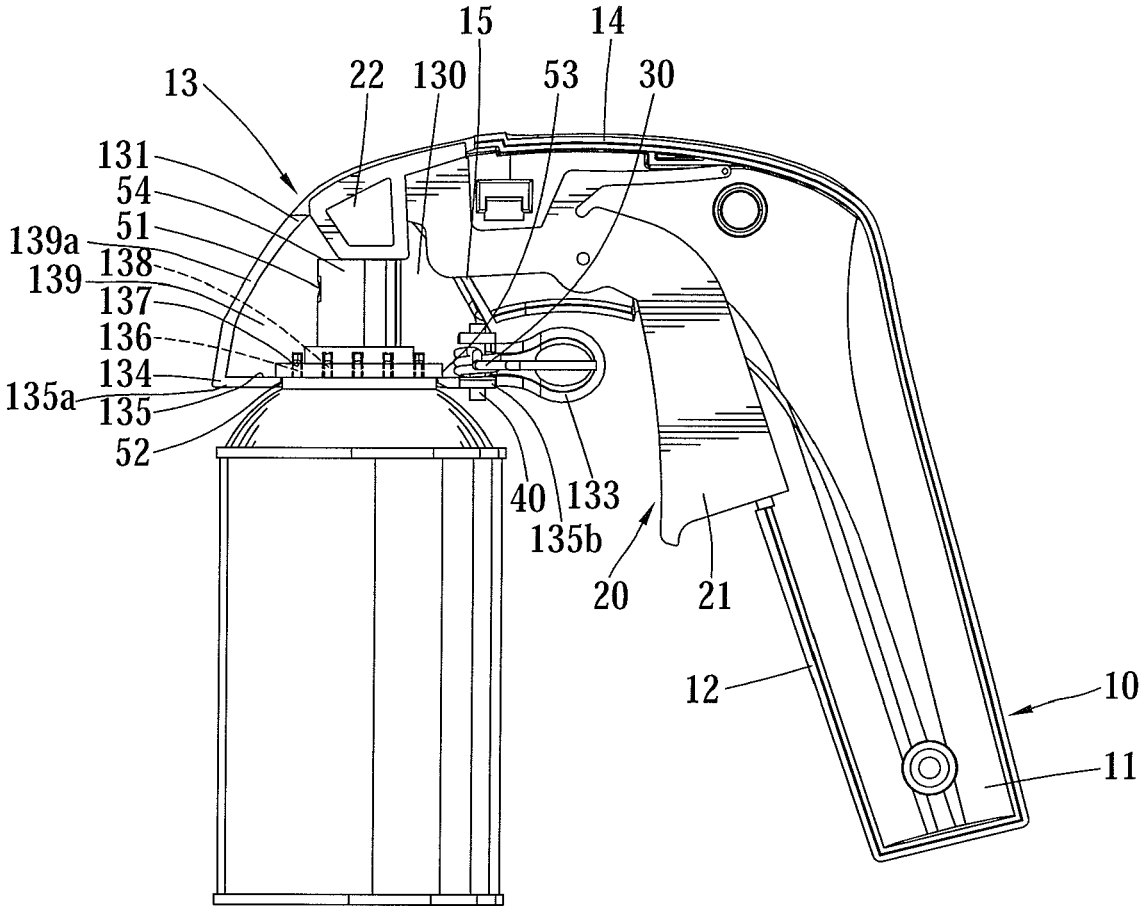
FIG. 4 is a cross-sectional view of the holding and actuating device in another position than shown in FIG. 1.

Referring to FIG. 4, the first end 21 of the trigger 20 is pushed so that the push-button valve 54 is pushed by the second end 22 of the trigger 20. Spray leaves the nozzle 51 and further travels through the aperture 131.

Figure 9:
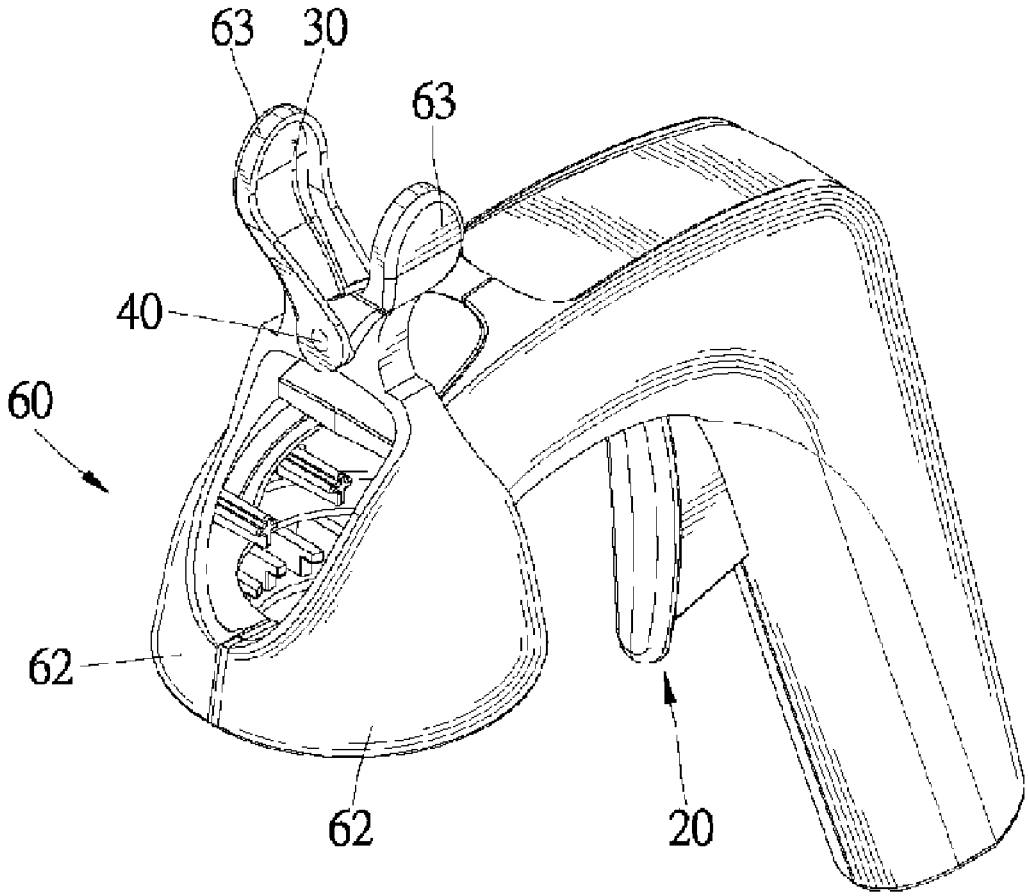
FIG. 9 is a perspective view of a holding and actuating device according to the second embodiment of the present invention.
Figure 10:
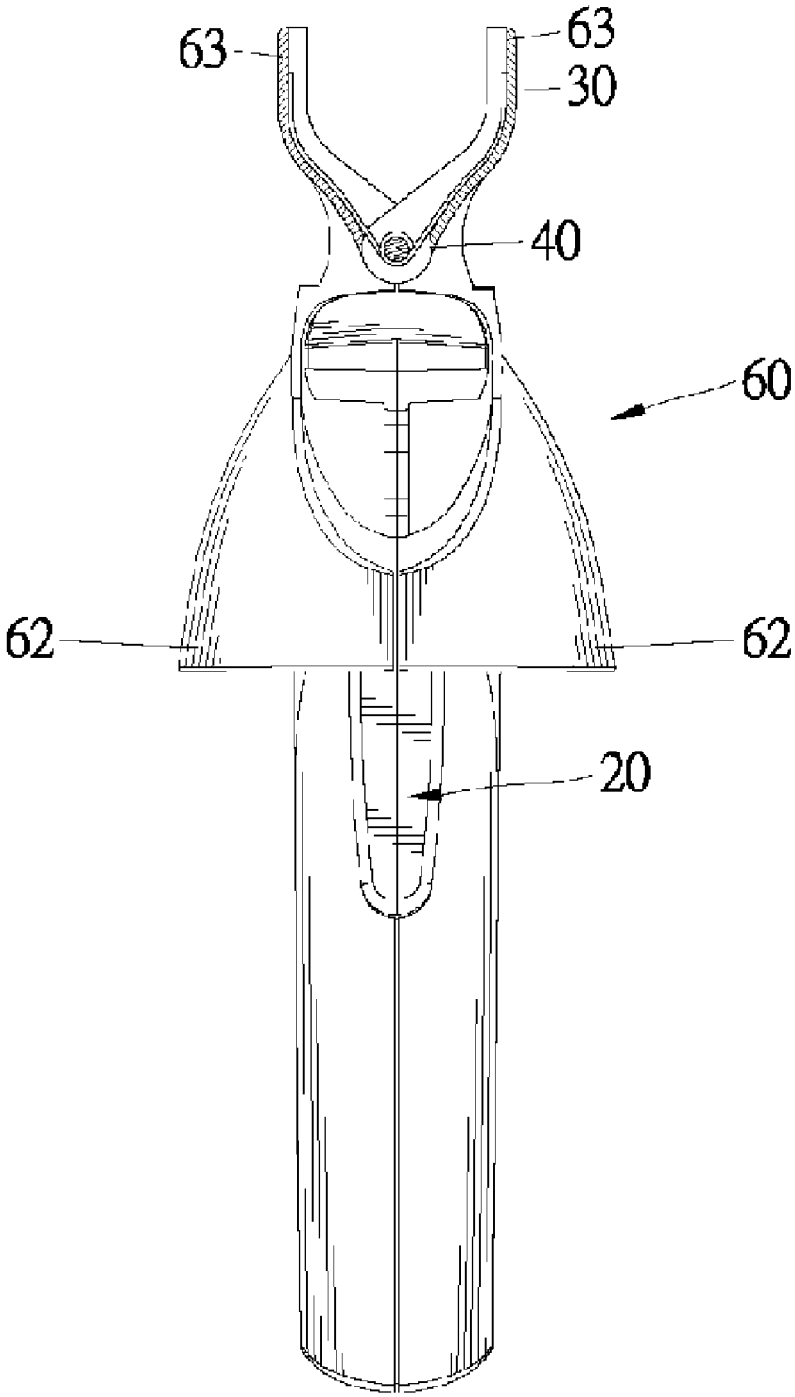
FIG. 10 is a front view of the holding and actuating device shown in FIG. 9.
Figure 11:
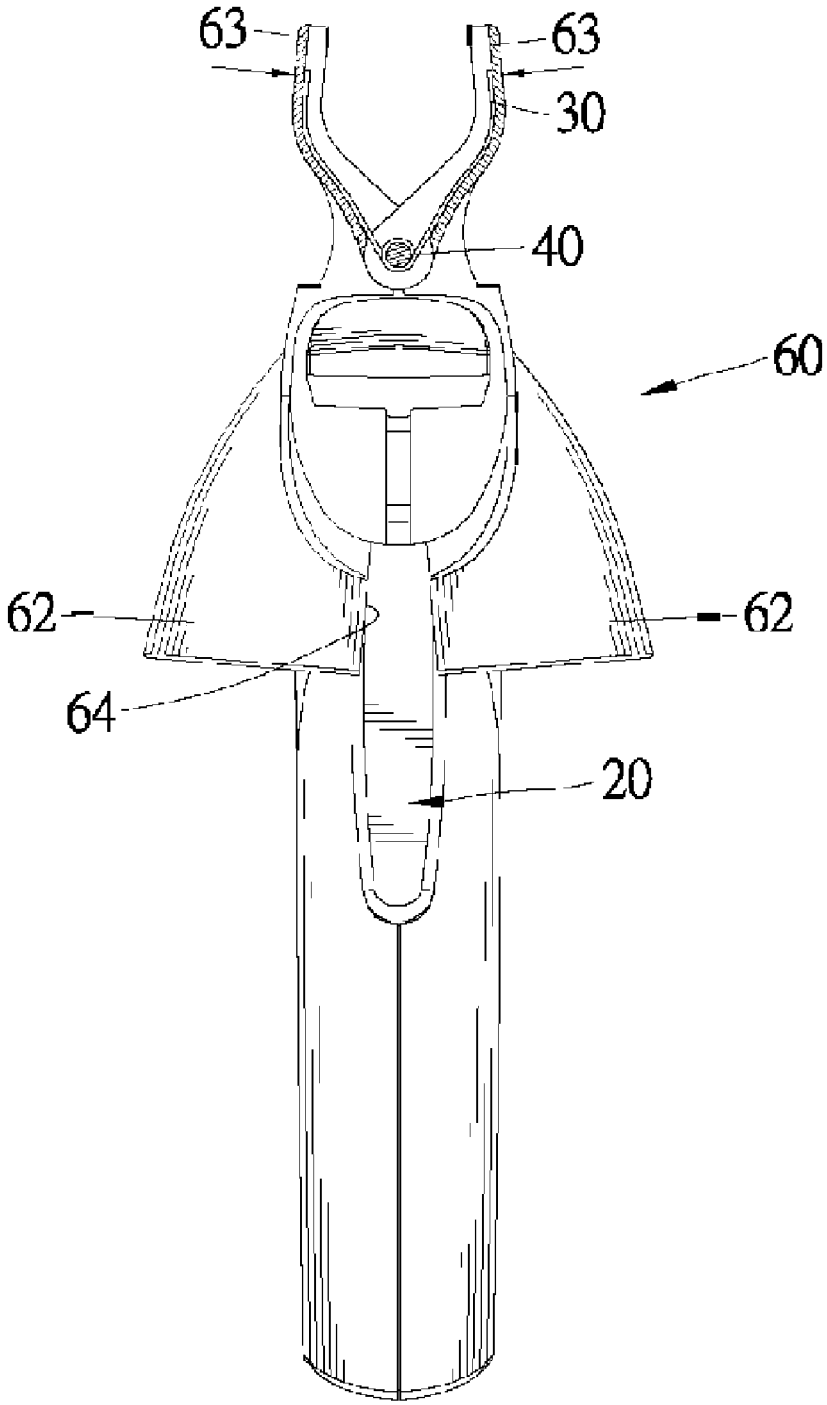
FIG. 11 is a front view of the holding and actuating device in another position than shown in FIG. 9.

Referring to FIGS. 9 through 11, there is shown a holding and actuating device according to a second embodiment of the present invention. The second embodiment is identical to the first embodiment except including a holder 60 instead of the holder 13. The holder 60 includes two jaws 62 and two handles 63. The holder 60 is like the holder 13 except that the jaws 62 and the handles 63 are pivotal in a vertical plane while the jaws 134 and the handles 133 are pivotal in a horizontal plane.

Referring to FIG. 10, the handles 63 are released so that the jaws 62 are closed. The neck 52 is clipped by the jaws 62.

Referring to FIG. 11, the handles 63 are pushed towards each other so that the jaws 62 are opened, and there is a gap 64 defined between the jaws 62. The jaws 62 are arranged around the neck 52.

Figure 12:
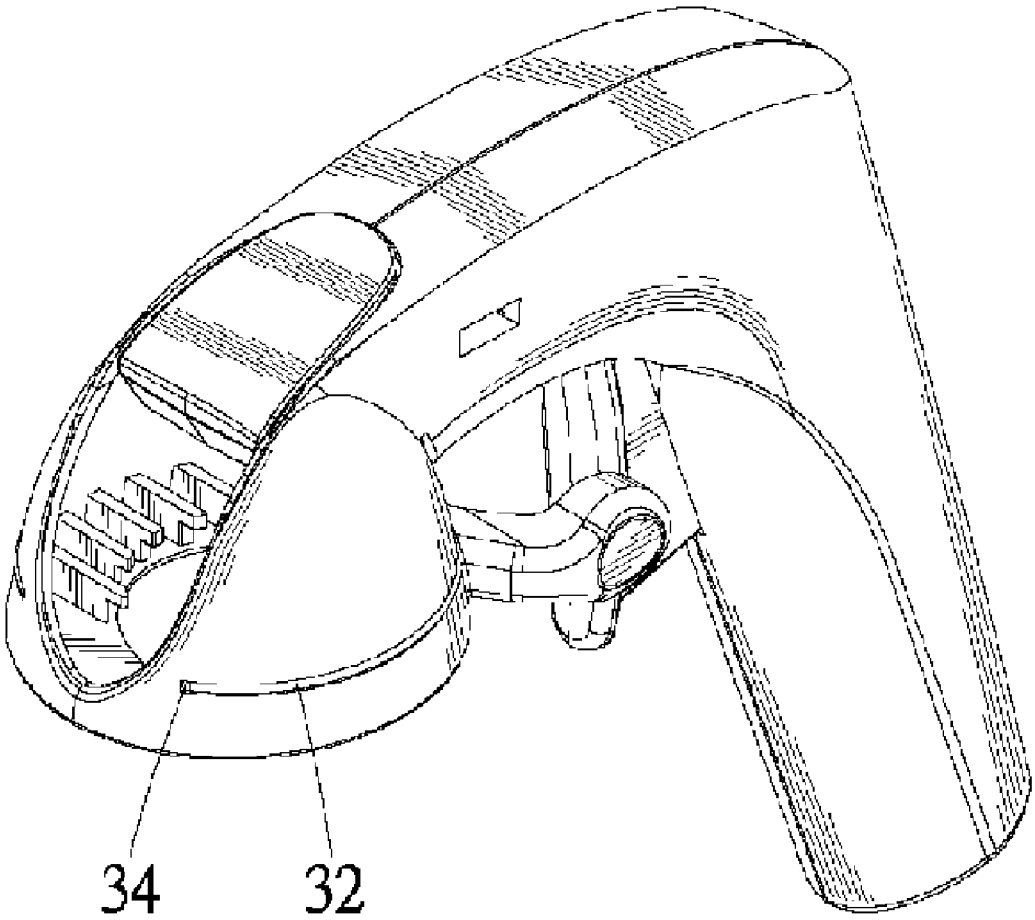
FIG. 12 is a perspective view of a holding and actuating device according to the third embodiment of the present invention.
Figure 13:
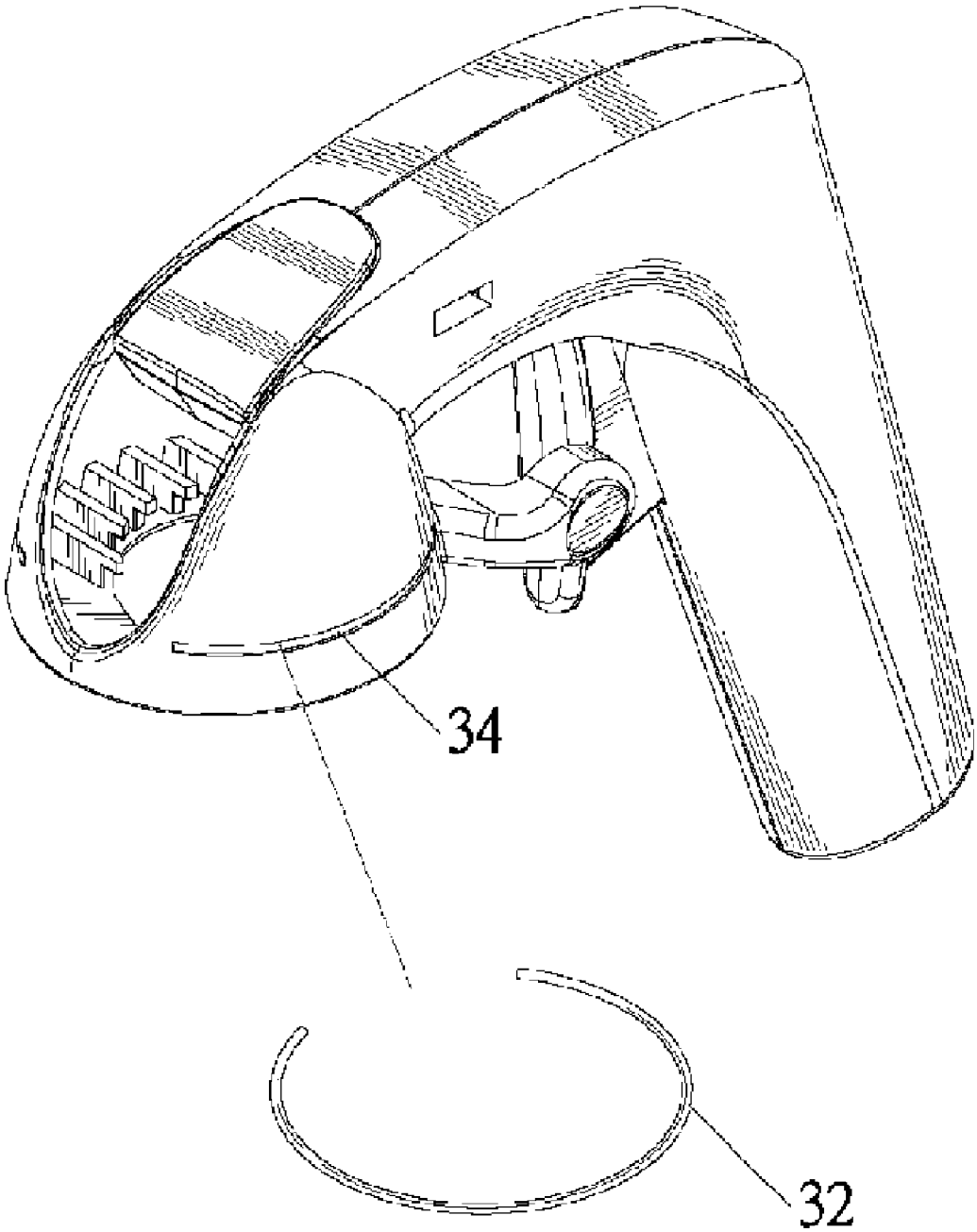
FIG. 13 is an exploded view of the holding and actuating device shown in FIG. 12.
Figure 14:
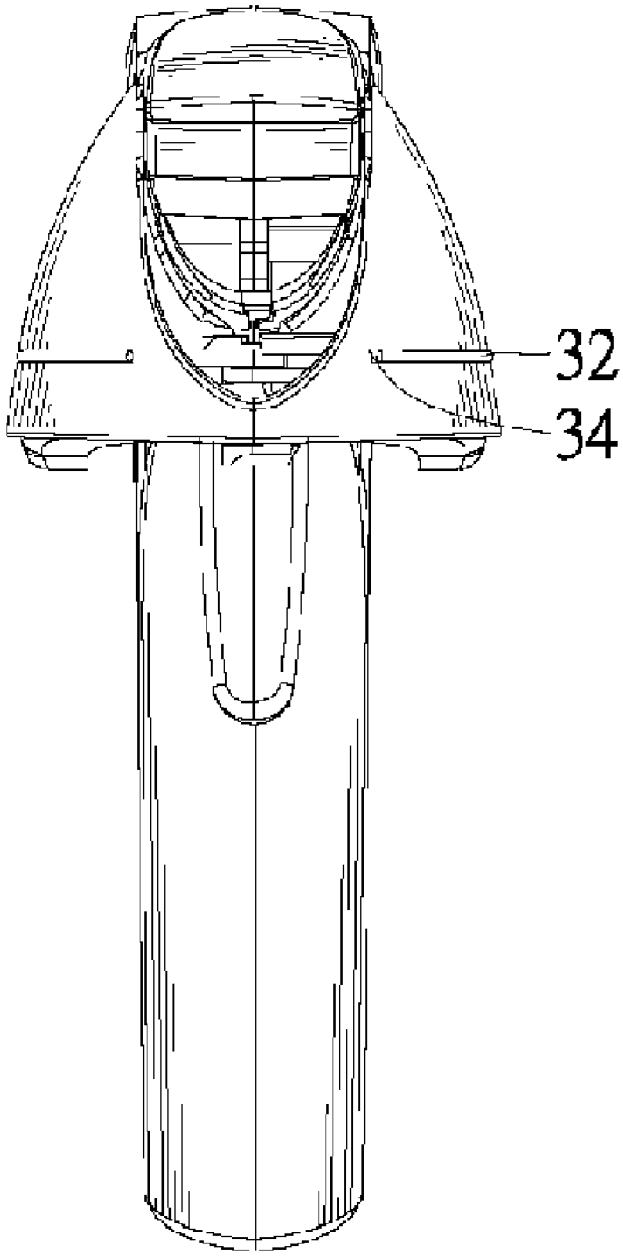
FIG. 14 is a front view of the holding and actuating device shown in FIG. 12.

Referring to FIGS. 12 through 14, there is shown a holding and actuating device according to a third embodiment of the present invention. The third embodiment is like the first embodiment except including a C-clip 32 arranged on the jaws 134 instead of the elastic element 30 arranged between the handles 133. The C-clip 32 includes two halves each located in a groove 34 defined in a related one of the jaws 134.

The holding and actuating device according to the present invention exhibits several advantages. Firstly, it is structurally simple, since most of the elements are made in one piece. Secondly, it is robust, since most of the elements are made in one piece and are not worn away by rubbing against one another. Thirdly, it provides convenient operation, because the jaws can be opened wider for receiving the neck of the bottle and because the handles provide large areas for contact with a user's fingers.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A device for holding and actuating a can comprising a neck, a rim formed on the neck, a push-button valve and a nozzle installed on the push-button valve, the device comprising:

a body comprising a handle and a connective portion extended from the handle;

a holder arranged on the connective portion of the body, for clipping the neck of the can and for supporting the rim of the can, wherein the holder defines a proximal end associated with the connective portion and a distal end opposite to the proximal end, wherein the distal end of the holder is outside the body, wherein the distal end of the holder comprises first and second jaws, with the first jaw pivotally connected to the second jaw, with the first jaw pivotal relative to the second jaw and the second jaw pivotal relative to the first jaw, with the holder further comprising first and second handles extended from the first and second jaws, wherein the first and the second handles are adjacent to the handle of the body and under the connective portion of the body, with the first and second handles moveable relative to the connective portion and operated by the user's fingers, with the first and second handles further being outside the body; and a trigger installed on the handle and formed with a first end to be operated by the user's finger and a second end inserted into the holder for contact with the push-button valve of the can.

2. The device according to claim 1 wherein the first and second jaws are opened when the first and second handles are pushed towards each other.

3. The device according to claim 1 wherein the holder further comprises an elastic element arranged on the first and second jaws.

4. The device according to claim 1 wherein the holder further comprises a pin pivotally connecting the first and second jaws.

5. The device according to claim 4 wherein the holder comprises an elastic element arranged between the first and second handles and mounted on the pin.

6. The device according to claim 5 wherein the elastic element is a torque spring, with the pin received in the torque spring.

7. The device according to claim 1 wherein the holder defines a space for containing the neck, rim, push-button valve and nozzle of the can.

8. The device according to claim 7 wherein the holder defines an aperture for alignment with the nozzle of the can.

9. The device according to claim 7 with each of the first and second jaws having a support surface of a C-shape, with the support surfaces of the first and second jaws each having a first end and a second end, with the first and second jaws having a closed position with the first ends abutting and with the second ends abutting and with the first and second jaws having an open position with the first ends spaced, with the support surfaces of the first and second jaws being pivotally connected, with each of the first and second jaws including a wall extending from the support surface and between the support surface and the connective portion, with each of the walls opposite to the support surface being flexibly connected to the connective portion, with the support surfaces and the walls defining the space, with each of the walls of the first and second jaws including a front edge, with an aperture formed between and by the front edges of the walls of the first and second jaws and spaced from the support surfaces and the connective portion, with the aperture in communication with the nozzle, with the front edges of the walls of the first and second jaws being spaced in the open position.

10. The device according to claim 9 with the connective portion being formed by first and second halves, with the first and second jaws and a related one of the first and second halves made as one piece, with an opening being defined between the walls of the first and second jaws and the related one of the first and second halves to increase the flexibility of the first and second jaws relative to the first and second halves of the connective portion.

11. The device according to claim 1 wherein each of the first and second jaws comprises a support surface for contact with a lower surface of the rim of the can.

12. The device according to claim 11 wherein each of the first and second jaws comprises at least one buckle extended from the support surface for contact with an upper surface of the rim of the can.

13. The device according to claim 12 wherein the buckle comprises a base extended from the support surface and a tip extended from the base.

14. The device according to claim 1 wherein the first and second jaws are pivoted in a horizontal plane.

15. The device according to claim 1 wherein the body comprises two halves joined together.

16. The device according to claim 15 wherein each of the two halves of the body comprises a half of the handle, a half of the connective portion and a related one of the first and second jaws.

17. The device according to claim 16 wherein each of the two halves of the body comprises an opening defined between a portion of the half of the connective portion and a portion of the related first and second jaws to increase flexibility of the related first and second jaws.

18. The device according to claim 17 wherein each of the two halves of the connective portion is made as one piece with a related one of the first and second jaws.

19. The device according to claim 16 wherein each of the two halves of the connective portion and a related one of the first and second jaws are made separately and then connected to each other.

* * * * *